US008980139B2

(12) United States Patent
Oh et al.

(10) Patent No.: US 8,980,139 B2
(45) Date of Patent: Mar. 17, 2015

(54) METAL PASTE MANUFACTURING METHOD FOR INTERNAL ELECTRODE OF MULTI LAYER CERAMIC CAPACITOR

(71) Applicant: Samhwa Capacitor Co., Ltd., Yongin-si (KR)

(72) Inventors: Young Joo Oh, Seoul (KR); Jung Rag Yoon, Yongin-si (KR)

(73) Assignee: Samhwa Capacitor Co., Ltd. (KR)

( * ) Notice: Subject to any disclaimer, the term of this patent is extended or adjusted under 35 U.S.C. 154(b) by 205 days.

(21) Appl. No.: 13/796,049

(22) Filed: Mar. 12, 2013

(65) Prior Publication Data

US 2013/0277622 A1 Oct. 24, 2013

(30) Foreign Application Priority Data

Apr. 19, 2012 (KR) ..... 10-2012-0041132

(51) Int. Cl.
*H01B 1/22* (2006.01)
*H01B 1/02* (2006.01)

(52) U.S. Cl.
CPC ..... *H01B 1/22* (2013.01)
USPC ..... 252/513; 252/512; 252/514; 264/614; 264/656; 361/301.4; 361/305; 361/321.2; 361/321.4; 501/65

(58) Field of Classification Search
CPC ..... H01G 4/005; H01G 4/1227
USPC ..... 252/512, 513, 514; 264/614, 656; 361/301.4, 305, 321.2, 321.4; 501/65
See application file for complete search history.

(56) References Cited

U.S. PATENT DOCUMENTS

| | | | | |
|---|---|---|---|---|
| 5,877,934 | A | 3/1999 | Sano et al. | |
| 7,435,360 | B2 * | 10/2008 | Oda et al. | 252/513 |
| 7,851,393 | B2 * | 12/2010 | Sohn et al. | 501/65 |
| 2004/0065986 | A1 * | 4/2004 | Otsuka | 264/614 |
| 2009/0225494 | A1 * | 9/2009 | Yamazaki | 361/321.4 |
| 2012/0110807 | A1 * | 5/2012 | Kim et al. | 29/25.41 |

FOREIGN PATENT DOCUMENTS

JP 2000269073 9/2000

* cited by examiner

*Primary Examiner* — Khanh Tuan Nguyen
(74) *Attorney, Agent, or Firm* — Cantor Colburn LLP

(57) ABSTRACT

A method of manufacturing a metal paste for an internal electrode according to the present invention includes preparing each of a metal powder and an organic vehicle; preparing a ceramic inhibitor powder in which a nano glass added with a rare-earth element is mixed; manufacturing a primary mixture by mixing the metal powder of 70 to 95 wt % and the ceramic inhibitor powder of 5 to 30 wt % when each of the metal powder, the organic vehicle, and the ceramic inhibitor powder in which the nano glass added with the rare-earth element is mixed is prepared; manufacturing a secondary mixture by mixing the primary mixture of 50 to 70 wt % and the organic vehicle of 30 to 50 wt % when the primary mixture is manufactured; and manufacturing the metal paste for the internal electrode by filtering the secondary mixture when the secondary mixture is manufactured.

10 Claims, 2 Drawing Sheets

METAL PASTE MANUFACTURING METHOD FOR INTERNAL ELECTRODE OF MULTI LAYER CERAMIC CAPACITOR

CROSS-REFERENCE TO RELATED APPLICATION

This application claims the benefit of Korean Patent Application No. 10-2012-0041132, filed on Apr. 19, 2012, in the Korean Intellectual Property Office, the disclosure of which is incorporated herein by reference.

BACKGROUND OF THE INVENTION

1. Field of the Invention

The present invention relates to a method of manufacturing a metal paste for an internal electrode of a multilayer ceramic capacitor (MLCC), and more particularly, to a method of manufacturing a metal paste for an internal electrode of an MLCC that may manufacture an internal electrode as a thin layer using nano glass added with a rare-earth element and ceramic inhibitor powder of which average particle size is controlled.

2. Description of the Related Art

Currently, ultra high capacitance is required for a multilayer ceramic capacitor (MLCC). The MLCC may achieve the ultra high capacitance by manufacturing each of a dielectric sheet and an internal electrode as a thin film and thereby increasing the number of layers. A method of constructing the MLCC to have the ultra high capacitance may include a method of increasing the number of layers by forming a thickness of the dielectric sheet or the internal electrode as a thin film. In the case of forming the internal electrode as the thin film, shrinkage becomes serious whereby disconnection or aggregation of the internal electrode occurs. Accordingly, defect such as degradation in capacitance, short between internal electrodes, and the like may increase.

The disconnection or aggregation of the internal electrode occurs due to a shrinkage difference since a great sintering difference occurs by using different heterogeneous materials, that is, a ceramic material and a metal material for the dielectric sheet and the internal electrode when manufacturing the MLCC. A method of decreasing the shrinkage of the dielectric sheet and the internal electrode may inhibit sintering of a metal by adding a ceramic inhibitor to a metal paste for an internal electrode. The ceramic inhibitor is used as a sintering delaying material. When a nickel powder is used for a metal powder for the internal electrode, the ceramic inhibitor may minimize a shrinkage difference with a dielectric material by maximally delaying a sintering shrinkage temperature point of nickel (Ni) at which sintering starts, that is, by initiating the sintering shrinkage at a relatively high temperature compared to a relatively low temperature of about 400 to 500° C.

The ceramic inhibitor serves to delay sintering of Ni that is the internal electrode during a sintering process of the MLCC, and comes out of to a dielectric layer when sintering of Ni is completed and thereby affects an electrical characteristic of the dielectric material. Accordingly, a powder similar to a dielectric composition is used as an inhibitor. Also, when a size of the ceramic inhibitor is greater than a size of metal powder, a filling rate decreases, sintering shrinkage increases, sintering of the metal powder is not effectively controlled, and thus, a sintering starting temperature decreases. Accordingly, the ceramic inhibitor having a particle size less than the metal powder is generally used as a sintering delaying material.

Japanese Publication Patent No. 2000-269073 (published date: Sep. 29, 2000.) discloses a multilayer ceramic condenser and a manufacturing method thereof that may manufacture a metal paste for an internal electrode by adding, to a metal powder, ceramic inhibitor $BaTiO_3$ and one of La and Cr that are rare-earth elements. Japanese Publication Patent No. 2000-269073 may increase content of the ceramic inhibitor $BaTiO_3$ by adding the rare-earth element La or Cr to the metal paste for the internal electrode. Accordingly, continuity of the internal electrode is secured and capacitance of the MLCC increases.

Even though the method of manufacturing the metal paste for the internal electrode of the MLCC according to the related art may increase content of ceramic inhibitor through addition of a rare-earth element, the rare-earth element is diffused to a dielectric sheet to thereby be against a dielectric component. Accordingly, an electrical characteristic of the MLCC may vary and the average particle size of a ceramic inhibitor powder may significantly increase. Accordingly, it may be difficult to form the internal electrode to be thin and it is also difficult to achieve ultra high capacitance of the MLCC.

SUMMARY OF THE INVENTION

The present invention provides a method of manufacturing a metal paste for an internal electrode of a multilayer ceramic capacitor (MLCC) that may manufacture an internal electrode as a thin layer using a nano glass added with a rare-earth element and a ceramic inhibitor powder of which average particle size is controlled.

The present invention also provides a method of manufacturing a metal paste for an internal electrode of an MLCC that may minimize a reaction between a dielectric element and an electrode during sintering by adding a nano glass added with a rare-earth element to a ceramic inhibitor powder of which average particle size is controlled, thereby enhancing reliability of an MLCC.

The present invention also provides a method of manufacturing a metal paste for an internal electrode of an MLCC that may minimize a shrinkage difference with a dielectric element by forming an internal electrode to have a uniform thickness and stabilizing a sintering temperature of the internal electrode when manufacturing the internal electrode as a thin layer, and may also uniformly manufacture a dielectric composition, thereby enhancing a dielectric characteristic of the dielectric element and reliability.

According to an aspect of the present invention, there is provided a method of manufacturing metal paste for internal electrode of an MLCC, the method including preparing each of a metal powder and an organic vehicle; preparing a ceramic inhibitor powder in which a nano glass added with a rare-earth element is mixed; manufacturing a primary mixture by mixing the metal powder of 70 to 95 wt % and the ceramic inhibitor powder of 5 to 30 wt % when each of the metal powder, the organic vehicle, and the ceramic inhibitor powder in which the nano glass added with the rare-earth element is mixed is prepared; manufacturing a secondary mixture by mixing the primary mixture of 50 to 70 wt % and the organic vehicle of 30 to 50 wt % when the primary mixture is manufactured; and manufacturing the metal paste for the internal electrode by filtering the secondary mixture when the secondary mixture is manufactured.

BRIEF DESCRIPTION OF THE DRAWINGS

The above and/or other aspects of the present invention will become apparent and more readily appreciated from the following description of the exemplary embodiments, taken in conjunction with the accompanying drawings in which.

DETAILED DESCRIPTION OF THE INVENTION

Figure 1:
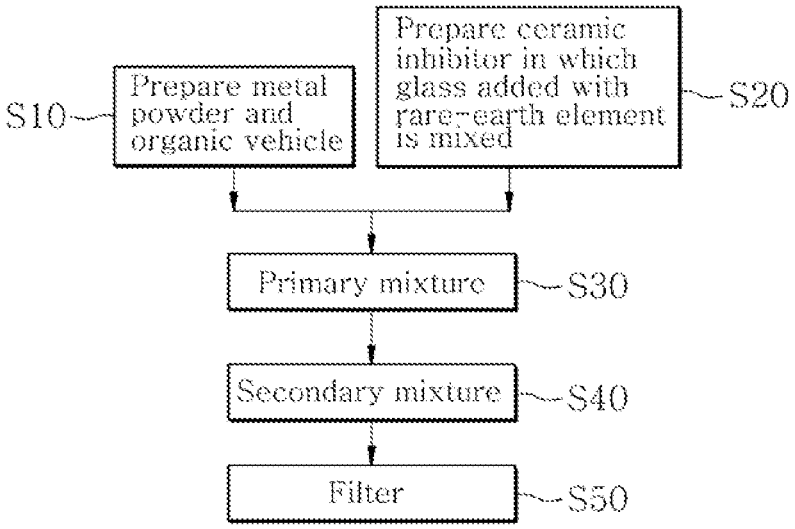
FIG. 1 is a flowchart illustrating a method of manufacturing a metal paste for an internal electrode of a multilayer ceramic capacitor (MLCC) of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

Hereinafter, a method of manufacturing a metal paste for an internal electrode of a multilayer ceramic capacitor (MLCC) according to an embodiment of the present invention will be described with reference to the accompanying drawings.

As illustrated in FIG. 1, the method of manufacturing the metal paste for the internal electrode of the MLCC of the present invention includes preparing a metal powder and an organic vehicle (S10), preparing each of a ceramic inhibitor powder in which a nano glass added with a rare-earth element is mixed (S20), manufacturing a primary mixture by mixing the metal powder of 70 to 95 wt % and the ceramic inhibitor powder of 5 to 30 wt % when each of the metal powder, the organic vehicle, and the ceramic inhibitor powder in which the nano glass added with the rare-earth element is mixed is prepared (S30), manufacturing a secondary mixture by mixing the primary mixture of 50 to 70 wt % and the organic vehicle of 30 to 50 wt % when the primary mixture is manufactured (S40), and manufacturing the metal paste for the internal electrode by filtering the secondary mixture when the secondary mixture is manufactured (S50).

Hereinafter, the method of manufacturing the metal paste for the internal electrode of the MLCC of the present invention constructed as above will be described in detail.

In the method of manufacturing the metal paste for the internal electrode of the MLCC of the present invention, each of the metal powder and the organic vehicle is prepared (S10). In operation S10 of preparing each of the metal powder and the organic vehicle, a nickel (Ni) powder having the average particle size of about 50 to 200 nm is used for the metal powder. The organic vehicle includes a binder of 1 to 20 wt %, an organic solvent of 40 to 80 wt %, and a plasticizer of 0.1 to 2 wt %. Here, ethyl cellulose (EC) is used for the binder, one of terpineol, α-terpineol), dethydro-terpineol, and dethydro-terpineol-acetate is used for the organic solvent, and di-2-ethylhexyl phthalate (DOP) is used for the plasticizer.

In addition to preparing the metal powder and the organic vehicle, the ceramic inhibitor powder in which the nano glass added with the rare-earth element is mixed is prepared (S20). In this operation S20, an element having the average particle size of about 10 to 300 nm and a specific surface area of about 5 to 40 $m^2/g$ is used for the ceramic inhibitor powder in which the nano glass added with the rare-earth element is mixed.

Figure 2:
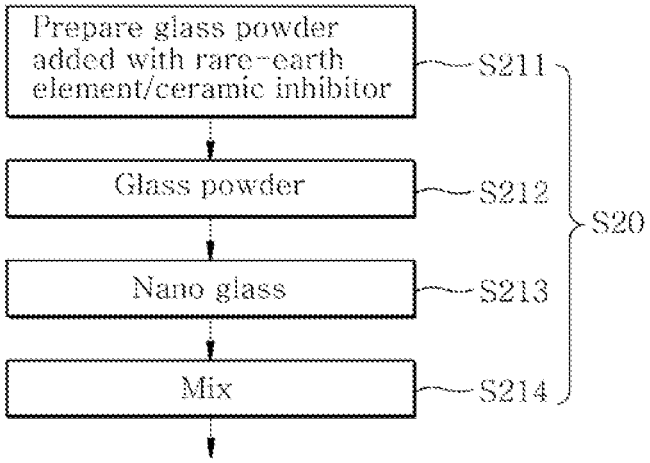
FIGS. 2 and 3 are flowchart illustrating embodiments of a method of manufacturing a ceramic inhibitor powder in which a nano glass added with a rare-earth element is mixed as illustrated in FIG. 1.
Figure 3:
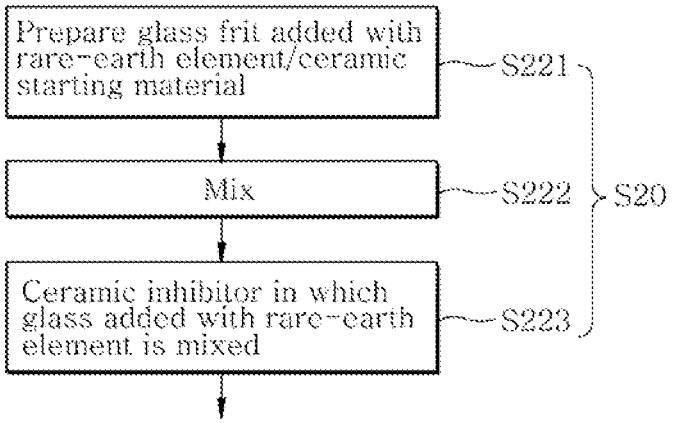

FIGS. 2 and 3 illustrate the method of manufacturing the ceramic inhibitor powder in which the nano glass added with the rare-earth element is mixed so that the average particle size may become about 10 to 300 nm and the specific surface area may become about 5 to 40 $m^2/g$.

The method of manufacturing the ceramic inhibitor powder in which the nano glass added with the rare-earth element is mixed as illustrated in FIG. 2 relates to manufacturing the ceramic inhibitor powder by manufacturing the nano glass as a spherical shape using a glass frit added with the rare-earth element and then mixing the nano glass with a ceramic inhibitor. Initially, the glass frit added with the rare-earth element and the ceramic inhibitor are prepared (S211). When the glass frit is prepared, a glass powder is manufactured by grinding the prepared glass frit so that a particle size of the glass frit becomes about 0.5 to 10 μm (S212). When the glass powder is manufactured, the glass powder is manufactured as a nano glass having a spherical shape and having a particle size of about 10 to 300 nm using a radio frequency (RF) thermal plasma (S213). When the nano glass is prepared, the ceramic inhibitor powder in which the nano glass added with the rare-earth element is mixed is manufactured by mixing the nano glass of 5 to 30 wt % and the ceramic inhibitor of 70 to 95 wt % (S214). Here. $BaTiO_3$ is used for a material of the ceramic inhibitor in operation S214, and the average particle size of $BaTiO_3$ is controlled to be about 10 to 100 nm.

The method of manufacturing the ceramic inhibitor powder in which the nano glass added with the rare-earth element is mixed as illustrated in FIG. 3 relates to manufacturing the ceramic inhibitor powder using the glass frit added with the rare-earth element and a ceramic starting material. Initially, the glass frit added with the rare-earth element and the ceramic starting material are prepared (S221). One of $BaTiO_3$, $BaCO_3$, and $TiO_2$ is selected and thereby used for the ceramic starting material. When the glass frit added with the rare-earth element and the ceramic starting material are prepared, the glass frit added with the rare-earth element and the ceramic starting material are mixed using one of a wet scheme and a dry scheme (S212). When mixing is completed, a mixture of the glass frit added with the rare-earth element and the ceramic starting material is manufactured as a ceramic inhibitor that has a spherical shape and has a particle size of about 10 to 300 nm and in which the glass frit added with the rare-earth element is mixed (S213).

In operation S211 of preparing the glass frit added with the rare-earth element and the ceramic inhibitor as illustrated in FIG. 2, and operation S221 of preparing the glass frit added with the rare-earth element and the ceramic starting material as illustrated in FIG. 3, the glass frit added with the rare-earth element is manufactured by melting and suddenly cooling $Re_2O_3$—CaO—$Al_2O_3$—$SiO_2$ in about 1450 to 1650° C., $Re_2O_3$—CaO—$Al_2O_3$—$SiO_2$ includes $Re_2O_3$ of 0.5 to 30 wt %, CaO of 1 to 10 wt %, $Al_2O_3$ of 10 to 25 wt %, and $SiO_2$ of 45 to 60 wt %. One of Y, Er, Eu, Dy, Sm, Nd, Yb, Lu, Sc, and La is selected and thereby used for Re.

RF thermal plasma torch equipment is used for the RF thermal plasma that is used to manufacture the glass powder or the glass frit added with the rare-earth element as a spherical nano glass, that is, a nano scale of particle powder. A method of manufacturing a spherical nano particle using the RF thermal plasma may obtain sufficient energy required for vaporization by making the glass powder and the like pass through a high temperature plasma center area of the RF thermal plasma torch. When the sufficient energy required for vaporization is accumulated, a nucleation is started by making the glass powder be deviated from the high temperature plasma center area of the RF thermal plasma torch and by suddenly cooling the glass powder. When suddenly cooling the glass powder and the like using cold vapor or solution at this point, the growth of the glass powder is inhibited and the glass powder is manufactured as a nano scale of ultra fine and spherical powder by a surface tension. The ceramic inhibitor is also manufactured as a nano scale of spherical and fine powder through the same method as the method used for manufacturing the glass powder.

When each of the metal powder, the organic vehicle, and the ceramic inhibitor powder in which the nano glass added with the rare-earth element is mixed is prepared, a primary mixture of FIG. 1 is manufactured by mixing the metal powder of 70 to 95 wt % and the ceramic inhibitor powder of 5 to 30 wt % (S30). The primary mixture is obtained by mixing the metal powder and the ceramic inhibitor powder using a jet milling method that is a dry milling method.

When the primary mixture is manufactured, a secondary mixture is manufactured by mixing the primary mixture of 50 to 70 wt % and the organic vehicle of 30 to 50 wt % (S40). In operation S40 of manufacturing the secondary mixture by mixing the primary mixture and the organic vehicle, the secondary mixture is manufactured by mixing the primary mixture of 30 to 70 wt %, the organic vehicle of 10 to 50 wt %, and a dispersant of 0.1 to 5 wt % using a 3-roll mill and then dispersing the same using a clear mixer, and nonylphenol ethoxylate phosphate ester is used for the dispersant.

When the secondary mixture is manufactured, the metal paste for the internal electrode is manufactured by filtering the secondary mixture (S50). Operation S50 of manufacturing the metal paste for the internal electrode by filtering the second mixture when the secondary mixture is manufactured secondary mixture manufactures the metal paste for the internal electrode by primarily filtering the secondary mixture using a 10 μm filter and then secondarily filtering the secondary mixture using a 1 to 3 μm filter.

Figure 4:
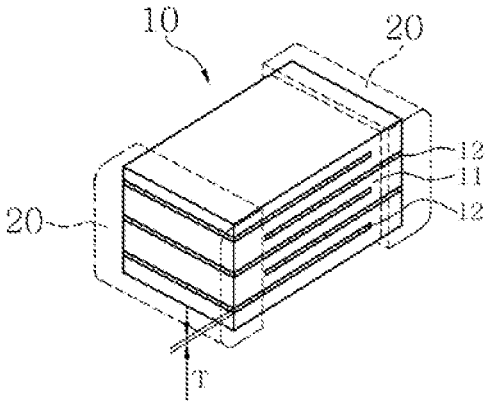
FIG. 4 is a perspective view of an MLCC applied with the method of manufacturing the metal paste for the internal electrode of the MLCC of the present invention.

FIG. 4 illustrates an MLCC manufactured using the method of manufacturing the metal paste for the internal electrode for the MLCC of the present invention.

The MLCC of FIG. 4 includes a ceramic sintering body 10 and a pair of external electrodes 20. The ceramic sintering body 10 includes a dielectric element 11 and a plurality of internal electrodes 12 formed to intersect each other within the dielectric element 11. The pair of external electrodes 20 are formed to be selectively connected to the plurality of internal electrodes 12, respectively.

A thickness T of the internal electrode 12 connected to the external electrode 20 is formed to be less than or equal to 1 μm. To uniformly form the internal electrode 12 to have the thickness T, a ceramic inhibitor powder is manufactured using a metal paste applied with a ceramic powder inhibitor of which average particle size is controlled to be about 10 to 300 nm and of which specific surface area is controlled to be about 5 to 40 $m^2/g$, that is, a ceramic powder inhibitor including the nano glass that is added with the rare-earth element having a particulate nano scale of the average particle size.

By applying the ceramic inhibitor powder having the average particle size of 10 to 300 nm to the metal paste for the internal electrode of the present invention, even when forming the internal electrode 12 as a thin layer, that is, to have the thickness T of less than or equal to 1 μm, it is possible to uniformly form the thickness T. In the case of manufacturing the metal paste for the internal electrode 12, by adding and mixing a glass material $Re_2O_3$—CaO—$Al_2O_3$—$SiO_2$, it is possible to increase sintering uniformity of the internal electrode 12, thereby minimizing a sintering shrinkage difference between the dielectric element 11 and the internal electrode 12.

As described above, a metal paste for an internal electrode manufactured through the manufacturing method of the present invention may be manufactured as a thin layer having a uniform thickness by employing, for the internal electrode, a nano glass added with a rare-earth element and a ceramic inhibitor powder of which average particle size is controlled. By adding the nano glass added with the rare-earth element to the ceramic inhibitor powder of which average particle size is controlled, it is possible to minimize a reaction between a dielectric element and an electrode during sintering, thereby enhancing the reliability of an MLCC.

Also, the metal paste for the internal electrode manufactured through the manufacturing method the present invention may minimize a shrinkage difference with the dielectric element by stabilizing a sintering temperature of the internal electrode, that is, by decreasing the sintering shrinkage of the metal paste. By minimizing the shrinkage difference with the dielectric element and uniformly forming a dielectric composition, it is possible to enhance a dielectric characteristic of the dielectric element and reliability.

Also, the metal paste for the internal electrode manufactured through the manufacturing method the present invention may minimize the sintering shrinkage of the metal paste by effectively delaying sintering of the metal paste. Accordingly, it is possible to decrease an internal stress that occurs due to the shrinkage difference, thereby preventing a short error, a degradation in breakdown voltage (BVD), and the like from occurring due to an internal structural defect such as crack or an aggregation body. Accordingly, it is possible to enhance an electrical characteristic, that is, insulation resistance, a dielectric constant, lifespan, and dielectric loss of the MLCC, thereby increasing the reliability.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A method of manufacturing a metal paste for an internal electrode of a multilayer ceramic capacitor (MLCC), the method comprising:

preparing each of a metal powder and an organic vehicle;

preparing a ceramic inhibitor powder in which a nano glass added with a rare-earth element is mixed;

manufacturing a primary mixture by mixing the metal powder of 70 to 95 wt % and the ceramic inhibitor powder of 5 to 30 wt % when each of the metal powder, the organic vehicle, and the ceramic inhibitor powder in which the nano glass added with the rare-earth element is mixed is prepared;

manufacturing a secondary mixture by mixing the primary mixture of 50 to 70 wt % and the organic vehicle of 30 to 50 wt % when the primary mixture is manufactured, and manufacturing the metal paste for the internal electrode by filtering the secondary mixture when the secondary mixture is manufactured.

2. The method of claim 1, wherein in the preparing of the metal powder and the organic vehicle, a nickel (Ni) powder having the average particle size of about 50 to 200 nm is used for the metal powder.

3. The method of claim 1, wherein in the preparing of the metal powder and the organic vehicle, the organic vehicle comprises a binder of 1 to 20 wt %, an organic solvent of 40 to 80 wt %, and a plasticizer of 0.1 to 2 wt %, ethyl cellulose (EC) is used for the binder, one of terpineol, α-terpineol, dethydro-terpineol, and dethydro-terpineol-acetate is used for the organic solvent, and di-2-ethylhexyl phthalate (DOP) is used for the plasticizer.

4. The method of claim 1, wherein in the preparing of the ceramic inhibitor powder in which the nano glass added with the rare-earth element is mixed, an element having the average particle size of about 10 to 300 nm and a specific surface area of about 5 to 40 $m^2/g$ is used for the ceramic inhibitor powder in which the nano glass added with the rare-earth element is mixed.

5. The method of claim 1, wherein the preparing of the ceramic inhibitor powder in which the nano glass added with the rare-earth element is mixed comprises:

preparing a glass frit added with the rare-earth element and a ceramic inhibitor;

manufacturing a glass powder by grinding so that a particle size of the glass frit becomes about 0.5 to 10 μm;

manufacturing the glass powder as a nano glass having a spherical shape and having a particle size of about 10 to 300 nm using a radio frequency (RF) thermal plasma when the glass powder is manufactured; and mixing the nano glass of 5 to 30 wt % and the ceramic inhibitor of 70 to 95 wt %, wherein in the preparing of the nano glass of 5 to 30 wt % and the ceramic inhibitor of 70 to 95 wt %, $BaTiO_3$ is used for a material of the ceramic inhibitor, and the average particle size of $BaTiO_3$ is about 10 to 100 nm.

6. The method of claim 5, wherein in the preparing of the glass frit added with the rare-earth element and the ceramic inhibitor, the glass frit added with the rare-earth element is manufactured by melting and then suddenly cooling $Re_2O_3$—CaO—$Al_2O_3$—$SiO_2$ in about 1450 to 1650° C., $Re_2O_3$—CaO—$Al_2O_3$—$SiO_2$ comprises $Re_2O_3$ of 0.5 to 30 wt %, CaO of 1 to 10 wt %, $Al_2O_3$ of 10 to 25 wt %, and $SiO_2$ of 45 to 60 wt %, one of Y, Er, Eu, Dy, Sm, Nd, Yb, Lu, Sc, and La is selected and thereby used for Re.

7. The method of claim 1, wherein in the preparing of the ceramic inhibitor powder in which the nano glass added with the rare-earth element is mixed comprises:

preparing a glass frit added with the rare-earth element and a ceramic starting material;

mixing the glass frit added with the rare-earth element and the ceramic starting material using one of a wet scheme and a dry scheme; and manufacturing a mixture of the glass frit added with the rare-earth element and the ceramic starting material as a ceramic inhibitor that has a spherical shape and has a particle size of about 10 to 300 nm and in which the glass frit added with the rare-earth element is mixed, wherein in the preparing of the ceramic starting material, one of $BaTiO_3$, $BaCO_3$, and $TiO_2$ is selected and thereby used for the ceramic starting material.

8. The method of claim 1, wherein in the manufacturing of the primary mixture, the primary mixture is manufactured by mixing the metal powder and the ceramic inhibitor powder using a dry mall-milling scheme.

9. The method of claim 1, wherein in the manufacturing of the secondary mixture by mixing the primary mixture and the organic vehicle, the secondary mixture is manufactured by mixing the primary mixture of 30 to 70 wt %, the organic vehicle of 10 to 50 wt %, and a dispersant of 0.1 to 5 wt % using a 3-roll mill and then dispersing the same using a clear mixer, and nonylphenol ethoxylate phosphate ester is used for the dispersant.

10. The method of claim 1, wherein the manufacturing of the metal paste for the internal electrode by filtering the second mixture when the secondary mixture is manufactured secondary mixture manufactures the metal paste for the internal electrode by primarily filtering the secondary mixture using a 10 μm filter and then secondarily filtering the secondary mixture using a 1 to 3 μm filter.

* * * * *